United States Patent [19]

Hafner et al.

[11] Patent Number: 4,698,860

[45] Date of Patent: Oct. 13, 1987

[54] SPRAYHEAD WITH BUILT-IN SOAP SYSTEM FOR MULTI PERSON WASHFOUNTAINS

[75] Inventors: V. Walter Hafner, Whittier; Ron T. Hahn, Fullerton; Keith D. Marshall, Whittier, all of Calif.

[73] Assignee: Acorn Engineering Company, City of Industry, Calif.

[21] Appl. No.: 920,764

[22] Filed: Oct. 20, 1986

[51] Int. Cl.[4] ..... A47K 1/04

[52] U.S. Cl. ..... 4/624

[58] Field of Search ..... 4/624, 620, 623; 222/129.1, 132, 179; 239/66, 204, 207, 558, 551

[56] References Cited

U.S. PATENT DOCUMENTS

| | | | |
|---|---|---|---|
| 1,836,766 | 12/1931 | Mullett et al. | 4/624 |
| 1,977,079 | 10/1934 | Mullett et al. | 4/624 |
| 2,051,644 | 8/1936 | Mullett | 4/624 |
| 2,227,388 | 12/1940 | Conner | 4/624 |
| 2,293,544 | 8/1942 | Heine et al. | 4/624 |
| 2,310,617 | 2/1943 | Conner | 4/624 |
| 2,836,080 | 5/1958 | Mullett | 4/624 |
| 3,722,007 | 3/1973 | Camp et al. | 4/624 |
| 4,145,769 | 3/1979 | MacFarlane et al. | 4/628 |

FOREIGN PATENT DOCUMENTS

| | | | |
|---|---|---|---|
| 1220654 | 5/1960 | France | 4/624 |

*Primary Examiner*—Henry J. Recla
*Assistant Examiner*—L. J. Peters
*Attorney, Agent, or Firm*—Edgar W. Averill, Jr.

[57] ABSTRACT

An improved sprayhead for group washfountains of the type having several washing stations positioned around a sprayhead located over a single bowl. The washfountain has a hollow sprayhead having an exterior wall which holds not only the nozzles but also a soap reservoir and hand actuated buttons. The valves which supply water to the nozzles are preferably positioned in the pedestal below the bowl of the washfountain.

18 Claims, 3 Drawing Figures

SPRAYHEAD WITH BUILT-IN SOAP SYSTEM FOR MULTI PERSON WASHFOUNTAINS

CROSS-REFERENCE TO RELATED APPLICATIONS

The present inventors have previously filed patent applications on the following related devices:

"DUAL OPERATED METERING VALVE CONNECTED TO BOTH A HAND OPERATED PUSH BUTTON AND A FOOT OPERATED PUSH BOTTON," Ser. No. 822,392, Filed Jan. 27, 1986, now U.S. Pat. No. 4,630,644.

"MANIFOLDING OF WATER CONTROL VALVE BODIES," Ser. No. 823,264, Filed Jan. 28, 1986.

"ROTATING CAP, SCREEN AND MOUNTING MEANS FOR PROTECTING AIR METERING VALVE," Ser. No. 823,392, Filed Jan. 28, 1986 now U.S. Pat. No. 4,630,638.

The above-identified applications are assigned to the assignee of the present application.

This present application is being filed the same day as an application titled, "WASTE FITTING WITH INTEGRALLY CAST ANCHOR" Ser. No. 06/920,452, filed Oct. 20, 1986. Both the present application and the application entitled "WASTE FITTING WITH INTEGRALLY CAST ANCHOR" are assigned to a common assignee.

BACKGROUND OF THE INVENTION

The field of the invention is plumbing devices and the invention relates more particularly to group washing systems which are commonly used in institutions such as schools, factories and similar locations. Such locations frequently use a line of lavatories mounted along a wall, each lavatory having its supply lines of hot and cold water together with a trap for each lavatory and a pair of shut-off valves for each lavatory. It is clear that a group washfountain reduces the number of supply lines, traps, valves and surfaces necessary for cleaning and results in a substantially lower cost, particularly in view of maintenance.

Many such group washfountains use a terrazzo bowl which is a mixture of cement and aggregate. Terrazzo tends to be porous and can easily erode with the constant impingement of water which leads to an unsightly and potentially unsanitary condition. Therefore, for terrazzo washfountains, water is typically dispersed in a manner which does not tend to erode the terrazzo bowl such as by a ring having a multiplicity of water outlets. The problem with such dispersed outlets, however, is the inability to concentrate sufficient water in any one spot to efficiently rinse the user's hands. One such washfountain is shown in U.S. Pat. No. 1,582,548. Sprayheads with a dispersed spray are shown in U.S. Pat. Nos. 2,766,074, 2,293,544, 2,398,149 and 3,630,447.

Additionally, the sprayhead for most washfountains is integral or adjacent to the plumbing valve such as shown in U.S. Pat. No. 2,398,149. Thus, there is not sufficient room for soap dispensers which are typically affixed above the washfountain in a relatively inconvenient area. Ideally, the soap should be dispensed at a point near the water stream so that the user can easily dispense soap onto wetted hands and, with equal ease, rinse the soap from the hands.

SUMMARY OF THE INVENTION

It is, thus, an object of the present invention to provide a group washfountain having soap dispensed in an optimal position and which also is capable of dispensing water in a relatively concentrated stream for ease of rinsing.

The present invention is for an improved group washfountain of the type having a plurality of individual washing stations positioned around a sprayhead located over a single bowl. The improvement of the present washfountain comprises a hollow sprayhead having an exterior wall and a downwardly facing base. An individual nozzle is held by the exterior wall for each station of the group washfountain. A soap reservoir is held within the hollow sprayhead. At least one soap dispenser is held by the base of the hollow sprayhead and the soap dispenser is fed by gravity. Preferably, the bowl of the improved washfountain is supported by legs which contain one or more remotely operated valves which supply the nozzles on the sprayhead. A preferred material of construction for the bowl is stainless steel and the remotely controlled valves may be actuated either by a foot button or a hand button or both. The hand-operated push button may also be located in the sprayhead to provide particularly convenient operation. The foot-operated button may be located at the base of the pedestal. Preferably, the soap reservoir within the sprayhead is torroidal in shape.

DESCRIPTION OF THE PREFERRED EMBODIMENTS

Figure 1:
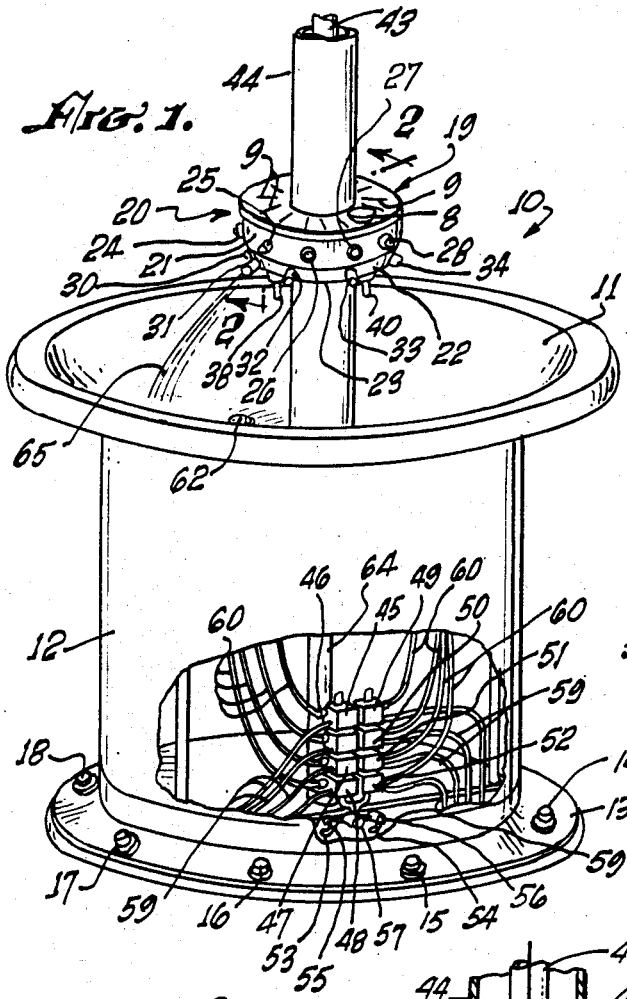
FIG. 1 is a perspective view, partially cut away of the group washfountain of the present invention.

A group washfountain is shown in perspective view in FIG. 1 and indicated generally by reference character 10. Washfountain 10 has a bowl 11 which is preferably fabricated from stainless steel, and bowl 11 is supported by legs surrounded by a hollow skirt 12, also preferably fabricated from stainless steel. The bowl may alternatively be supported by the skirt, itself. A stainless steel foot ring 13 surrounds the base of skirt 12 and holds a plurality of foot buttons 14 through 18. Group washfountains may be adapted to turn on all the nozzles when any foot button is depressed or, as shown in FIG. 1, to have each foot button operate a single nozzle or other combinations.

The cover 19 has a slightly sloped surface **19*a* and is actually a very shallow cone. Cover 19 has a plurality of ribs 9 which have a horizontal upper surface. This permits bars of soap to be placed on ribs 9 and any water dripping from the soap flows down along the upper surface 19*a* of cover 19 and into bowl 11. Ribs 9 hold the soap above the cover and allow it to readily dry by permitting air to circulate under the soap bar thereby providing a soap bar draining table. One or more soap filler caps 8 may be provided in cover 19** and such caps are, preferably, vandal resistant and are removable only with a special tool.

Figure 2:
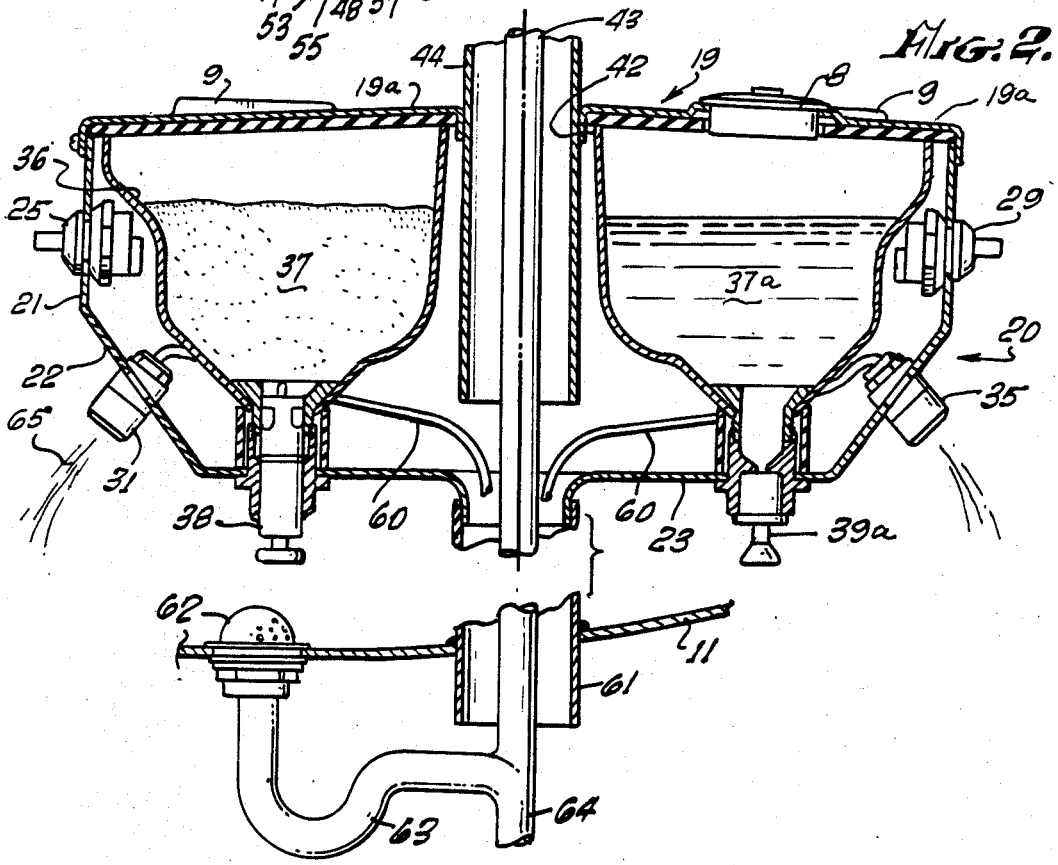
FIG. 2 is an enlarged cross-sectional view taken along line 2—2 of FIG. 1.

A particularly convenient feature of the washfountain of the present invention is the design of the sprayhead which is indicated generally by reference character 20. The term "sprayhead" is intended to indicate the support member which holds one or more nozzles. Sprayhead 20 is also, preferably, fabricated from stainless steel and has a cylindrical sidewall 21. The base of sprayhead 20 has a conical portion 22 and a floor 23 which is shown in FIG. 2. A plurality of hand-operated push buttons 24 through 29 (25 and 29 being shown in FIG. 2) are held by sidewall 21. Similarly, a plurality of nozzles 30 through 35 (31 and 35 being shown in FIG. 2) are held by the conical portion 22 of the base of sprayhead 20. As shown in FIG. 1, the valves which control water flow to the nozzles, such as nozzles 31 and 35, are not held within sprayhead 20 but instead are located in hollow skirt 12 as shown by the cutout portion in FIG. 1. In this way, sufficient room is available in sprayhead 20 to hold a large soap reservoir 36 which can contain powdered soap 37, liquid soap 37*a* or lotion soap. Soap reservoir 36 is connected to one or more soap dispensers 38 and 39.

FIG. 2 depicts a soap reservoir which shows powdered soap 37 on the left side and liquid soap 37*a* on the right side. Of course, the soap container is a single, generally torroidal container and would be filled either with a powdered soap or a liquid soap and the divided drawing of FIG. 2 is used merely to illustrate both styles in one figure. The soap dispenser 38 is of the type used to dispense powdered soap 37 and the soap dispenser 39*a* is of the type used to dispense liquid soap 37*a*.

Figure 3:
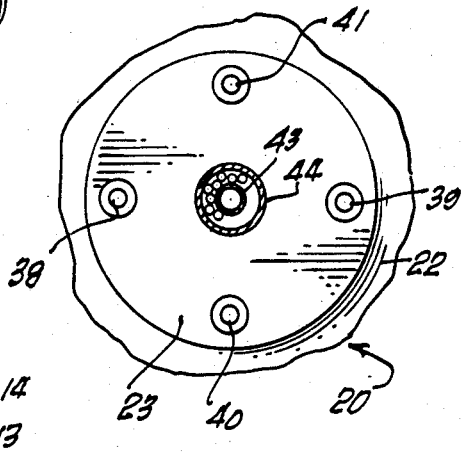
FIG. 3 is a bottom plan view of the torroidal soap reservoir of the washfountain of FIG. 1.

Soap reservoir 36 is shown in bottom plan view in FIG. 3 and can be seen to be generally torroidal in shape. Soap reservoir 36 has a hollow center cylinder 42 which permits the passage of vent pipe 43 which is hidden behind vent cover 44 which typically extends to the ceiling of the room in which the washfountain is installed.

Soap reservoir 36 is preferably fabricated from a polymer such as polyethylene and because of the substantial amount of room provided within sprayhead 20, the soap tank can have a large capacity such as six quarts of soap. This reduces the servicing necessary and also reduces the chance that all the soap will be used at any given time.

Turning now to the details of the valve placement and operation, it can be seen in the cutaway portion of FIG. 1 that a plurality of remotely controlled valves 45 through 52 are supplied from a hot water line 53 and a cold water line 54 which passes through check stop strainers 55 and 56 into a mixing and shutoff valve 57 to provide a source of tempered water to valves 45 through 52.

The unit shown in FIG. 1 has both foot buttons and hand-operated push buttons which permit the individual remote operation of each nozzle, either by a hand-operated push button or by a foot button. Furthermore, the unit may have a single remotely-controlled valve which is connected to all nozzles so that the pushing of any hand or foot button would turn on all nozzles simultaneously. The remotely-controlled valves may be the type which provide a time cycle, and this type of valve is described in applicants'co-pending applications, Ser. Nos. 822,383, 822,392, 823,264, 823,392 and which are operated by air. The air lines leading to the push buttons are indicated by reference character 58 and those leading to the foot buttons are indicated by reference character 59. A water line 60 passes from each valve to each nozzle which permits the sprayhead 20 to have sufficient space for including a large soap reservoir. The air lines 58 and the water lines 60 pass through the interior of stainless steel support column 61 which may also surround a vent pipe 43. Bowl 11 has a drain covered by beehive strainer 62 which withholds debris from the drain system which includes trap 63 which connects to drain pipe 64. In some installations, the water lines may be supplied from above the unit through one or more water supply lines located in vent cover 44.

It can be seen that the washfountains of the present invention require a minimum of field installation labor. They are far less expensive to install than individual lavatories because only one washfountain is installed versus up to eight lavatories. There is a minimum of loose pieces and no mechanisms to assemble and one man can make the installation of a stainless steel bowl with no possibility of breakage compared to two required for a heavier terrazzo bowl. Another advantage of the sprayhead and washfountain is that it is readily made to be vandal resistant. The water valves and soap supply are all secured behind covers which are securable with vandal resistant fasteners.

Another substantial advantage referred to above is the ability to use a relatively concentrated spray of water which is indicated by reference character 65 in FIG. 1. Since bowl 11 is, preferably, a stainless steel bowl, the impinging of waterspray 65 on bowl 11 causes no eroding. The nozzles, while providing a concentrated flow of water, can still provide a relatively low flow rate of water such as 0.4 gallons per minute. Since the water is in a relatively concentrated spray, this flow rate is sufficient for rapid rinsing. Since the nozzles are, preferably, supplied with tempered water, there is not the typical waste of water while the user adjusts individual cold and hot water faucets.

Washfountains made according to the present invention may be provided as an island washfountain such as that shown in FIG. 1 of the drawings or, alternatively, may be installed against a wall or in a corner. The sprayhead for some installations need not carry a vent pipe and, thus, may terminate with the top cover.

The washfountains of the present invention provide substantial savings particularly as compared to individual lavatory units. They save not only in installation and maintenance but also, because they may be fabricated from stainless steel, essentially eliminate replacement due to breakage. Furthermore, because of the ability to accurately control water flow rate, maximum water conservation results. Still further, such group washfountains permit a substantial savings in space as compared to individual lavatory units. Yet further, operation by foot buttons is far more easily obtained with the design of the present invention as compared to conventional lavatories. Also, such washfountains are readily used by the handicapped since the bowl extends away from the skirt.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved group washfountain of the type having a plurality of washing stations positioned around a sprayhead located over a single bowl wherein the improvement comprises:

a hollow sprayhead mounted above said bowl having an exterior wall and a downwardly facing base;

an individual nozzle for each station of said group washfountain, each such nozzle being held by said said sprayhead and directed toward said bowl;

valve means mounted remote from each said nozzle for operating each nozzle so that each nozzle is operated individually by said valve;

a soap reservoir held within said hollow sprayhead; and at least one soap dispenser, said soap dispenser being held by the base of said hollow sprayhead, said soap dispenser being fed by said soap reservoir.

2. The improved group washfountain of claim 1 wherein said bowl is supported over a hollow skirt, which skirt surrounds at least one remotely operated valve and each of said nozzles is connected to said at least one valve by a flexible conduit.

3. The improved group washfountain of claim 2 wherein said at least one remotely operated valve is actuated by a button held by said sprayhead.

4. The improved group washfountain of claim 2 wherein said at least one remotely operated valve is actuated by a foot button held at the base of said skirt.

5. The improved group washfountain of claim 1 wherein each valve is operated by a push button held by said sprayhead above each of said nozzles.

6. The improved group washfountain of claim 1 wherein each valve is operated by a foot button held at the base of said skirt below each of said nozzles.

7. The improved group washfountain of claim 1 wherein said soap reservoir is entirely torroidal in shape.

8. The improved group washfountain of claim 1 wherein said sprayhead is fabricated from stainless steel.

9. The improved group washfountain of claim 8 wherein said sprayhead has a cylindrical sidewall and a base which has a frustro-conical portion terminating in a flat floor and said nozzles are held by said frustro-conical portion and said soap dispenser is held by said flat floor.

10. The improved group washfountain of claim 8 wherein said sprayhead has a generally flat but slightly sloped top positioned over said soap reservoir thereby providing a soap bar draining table.

11. The improved group washfountain of claim 10 wherein said top has at least one removable cover positioned over at least one opening through said top.

12. An improved group washfountain of the type having a plurality of washing stations positioned around a sprayhead located over a single bowl wherein the improvement comprises:

a stainless steel bowl supported by leg means;

a hollow stainless steel sprayhead mounted above said bowl having an exterior wall and a downwardly facing base, said sprayhead being supported above said bowl by a pedestal;

an individual nozzle and valve for each station of said group washfountain, each such nozzle being held by said exterior wall of said sprayhead and directed toward said bowl and each such nozzle being supplied with water by a flexible, plastic line from a valve means mounted remote from each said nozzle, for operating each nozzle, so that each nozzle is operated individually by said valve;

a generally torroidal soap reservoir held within said hollow sprayhead; and a plurality of soap dispensers, each soap dispenser being held by the base of said hollow sprayhead, each soap dispenser being gravity fed by said soap reservoir.

13. The improved group washfountain of claim 12 wherein each of said remotely controlled valves is operated by a plurality of push buttons beld by said exterior wall of said sprayhead.

14. The improved group washfountain of claim 12 wherein each of said remotely controlled valves is operated by a pluraity of foot buttons held at the base of said leg means.

15. The improved group washfountain of claim 12 wherein each of said remotely controlled valves is operated by air conveyed in a flexible plastic line from said push button to said valve.

16. The improved group washfountain of claim 12 wherein each of said remotely controlled valves is operated by air conveyed in said flexible plastic line from a foot button to said valve.

17. The improved group washfountain of claim 12 further including a stainless steel vent cover extending upwardly from the top of said sprayhead to cover a vent pipe.

18. An improved group washfountain of the type having a plurality of washing stations positioned around a sprayhead located over a single bowl wherein the improvement comprises:

a hollow sprayhead mounted above said bowl having an exterior wall and a downwardly facing base;

an individual nozzle for each station of said group washfountain, each such nozzle being held by said sprayhead and directed toward said bowl and each such nozzle being fed by a flexible, plastic line; valve means mounted remote from each said nozzle, for operating each nozzle, so that each nozzle is operated individually by said valve, controlling the flow of water to said individual nozzles with a nozzle for each station;

a soap reservoir held within said hollow sprayhead;

at least one soap dispenser, said soap dispenser being held by the base of said hollow sprayhead, said soap dispenser bed by said soap reservoir and said soap dispenser dispensing soap at a level below each of said individual nozzles; and a generally torroidal soap reservoir held within said hollow sprayhead.

* * * * *